United States Patent [19]

Dietrich

[11] Patent Number: 4,690,060

[45] Date of Patent: Sep. 1, 1987

[54] GENERATING GAS PRESSURE IN AN EXPANSION CHAMBER

[75] Inventor: Albert Dietrich, Markdorf, Fed. Rep. of Germany

[73] Assignee: Dornier GmbH, Friedrichshafen, Fed. Rep. of Germany

[21] Appl. No.: 695,688

[22] Filed: Jan. 28, 1985

[30] Foreign Application Priority Data

Feb. 1, 1984 [DE] Fed. Rep. of Germany ..... 3403352

[51] Int. Cl.[4] ..... C06D 5/00; F41F 1/00; F42B 13/50

[52] U.S. Cl. ..... 102/352; 102/530; 102/351

[58] Field of Search ..... 102/530, 531, 351, 352, 102/340, 342, 357, 440, 489, 505, 311, 275.7, 200; 280/736

[56] References Cited

U.S. PATENT DOCUMENTS

| | | | |
|---|---|---|---|
| 3,089,418 | 5/1963 | Stiefel | 102/531 |
| 3,901,530 | 8/1975 | Radke | 280/736 |
| 4,358,998 | 11/1982 | Schneiter et al. | 102/530 |

*Primary Examiner*—Deborah L. Kyle
*Assistant Examiner*—Michael J. Carone
*Attorney, Agent, or Firm*—Ralf H. Siegemund

[57] ABSTRACT

A gas generator is provided for ejecting projectiles from a container under utilization of a developing gas pressure in an expansion chamber, using alternating propellant explosive charges hoses and ignition charge hoses in a string. String branching can be provided for.

7 Claims, 4 Drawing Figures

GENERATING GAS PRESSURE IN AN EXPANSION CHAMBER

BACKGROUND OF THE INVENTION

The present invention relates to the generation of a gas under pressure within an expansion chamber. Particularly for expelling projectiles, munition or other explosive charges from a container or the like.

Technology involving the blasting of rocks employs hoses filled with pyrotechnic substance. These hoses are known as detonation, explosion or ignition hoses or shot firing cable. Basically they are comprised of a hose made of a synthetic material and being filled with a pyrotechnical substance or having its inner wall coated with a thin continuous layer constituting such a substance. This latter kind of arrangement is known sometimes as ignition hose. The hoses of this type are sealed in one end and being provided with a time delay ignition at the other end. In order to determine the duration of ignition or charge combusion these hoses are usually provided with labels adhesively affixed to the hose and containing information on time interval numbers and the like. Also for holding the coiled hose suitable adhesive ribbons or clamps are provided.

Blasting explosive technique also knows a kind of linear detonation system wherein one or several fuse cords or ignition strands are provided and being held by different layers for example a first synthetic cover upon which is arranged a fiberglass mesh or braid around which in turn another synthetic cover is extruded and this arrangement holds the ignition or fuse cords in position and protects tehm against external effects or interferences. These linear ignition systems are for example used as fuses for gas generators for inflating air bags, igniting rocket drives or as fuse and detonation assists for large size military ordinance.

Military applications are known for example for U.S. Pat. No. 3,865,034. This patent discloses a gas pressure system which is arranged on the inside of a cylindrical casing and is provided for expelling submissiles stored therein. The particular device includes a tubular chamber being perforated by way of ports and being arranged coaxially to the cylindrical casing; the tubular chamber has end covers and extends over the entirety of the stored projectiles or submissiles. Moreover this tubular chamber is provided at a comparatively small caliber. Ignition system for the charge which in turn will cause the gas pressure to be produced. This ignition system is also arranged concentrical to the tubular chamber. The last memtioned charge occupies the annular space between the jacket of the tubular chamber and the ignition device. This ignition device itself is composed of an initiator explosive charge having the configuration of a solid cylinder with a closed area jacket made of an inert material. Moreover a propellant explosive charge is concentrically arranged to the initiator charge and is configured as a hollow cylinder. The ignition device includes furthermore a sleeve for receiving the propellant charge proper and the surrounding initiator charge.

The chamber in which the gas pressure develops on the other hand is enveloped by an expansion chamber having a circular cross section and being provided for cooling of the pressure gases as produced. Just as in the case of the pressure chamber the expansion chamber is configured as a perforated form stable tube and constitutes the outer chamber enclosure. The latter is jacketed by a deformable metal sleeve and a deflatable rubber skin having an internal contour corresponding to the sleeve contour and being provided so that the pressure gas as produced after flowing through the expansion chamber will expell all of the submissiles.

All these known ignition systems for providing a gas pressure have the disadvantage that after ignition of the respective gas producing substance in the respective combustion chamber a certain burn up effect continues which renders difficult the pressure control inside the expansion chamber. That means that the pressure production as it varies in time is difficult to control by the type of ignition system employed whereby particularly it is almost impossible to obtain a stepwise pressure increase. Moreover these ignition systems are inherently rather large which of course means a reduction in payload for a given size of container.

DESCRIPTION OF THE INVENTION

It is an object of the present invention to establish a controlled pressure build-up in an expansion chamber during the production of the pressurized gas under utilization of gas generation such that the expulsion of submissiles from a container runs through a sequence of steps such that the carrier container will not be unduly loaded.

It is therefore a particular object of the present invention to provide gas generation structure with an expansion chamber for the purpose of expelling projectiles from a container under utilization of a ignition charge.

In accordance with the preferred embodiment of the present invention, it is suggested to use explosive charge hoses being jacketed or otherwise protected against external influences and being interconnected through connectors with fuse or ignition hoses in alternating fashion one behind the other and they are protected against each other as far as pressure production is concerned. The lengths of each of these hoses is preselected in order to obtain a programmed development of gas pressure.

The invention offers the advantage that through selective distribution of ignition hoses for purposes of delay and connection between selected length of explosive charge hoses one obtains a controlled stepwise pressure buildup in the expansion chamber beginning with an initial ignition and running through the sequence of ignition and propellant charge hoses.

The propellant explosive charge hoses for developing the propellant pressure are therefore not ignited simultaneously or in a spontaneous fashion but in a particular sequence with preselected delays. The pressure build up in the expansion chamber is thus variably controllable through the appropriate connection pattern of selected ignition and propellant charge hoses. An added effect of the controlled pressure increase is obtainable through several parallel running branches or a combination of serial and serial parallel branches involving ignition hoses as delaying elements and propellant charge hoses. Such parallel branching enhances the reliability of operation and particularly of ignition in case of a multichamber ejection system.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 illustrates somewhat schematically a gas generator arrangement being situated inside an expansion chamber 2. The gas generator 1 is comprised of a series of propellant explosive charge hoses 3 alternating in a serial arrangement with ignition charge hoses 4, there being connectors 5 interposed accordingly.

Figure 1:
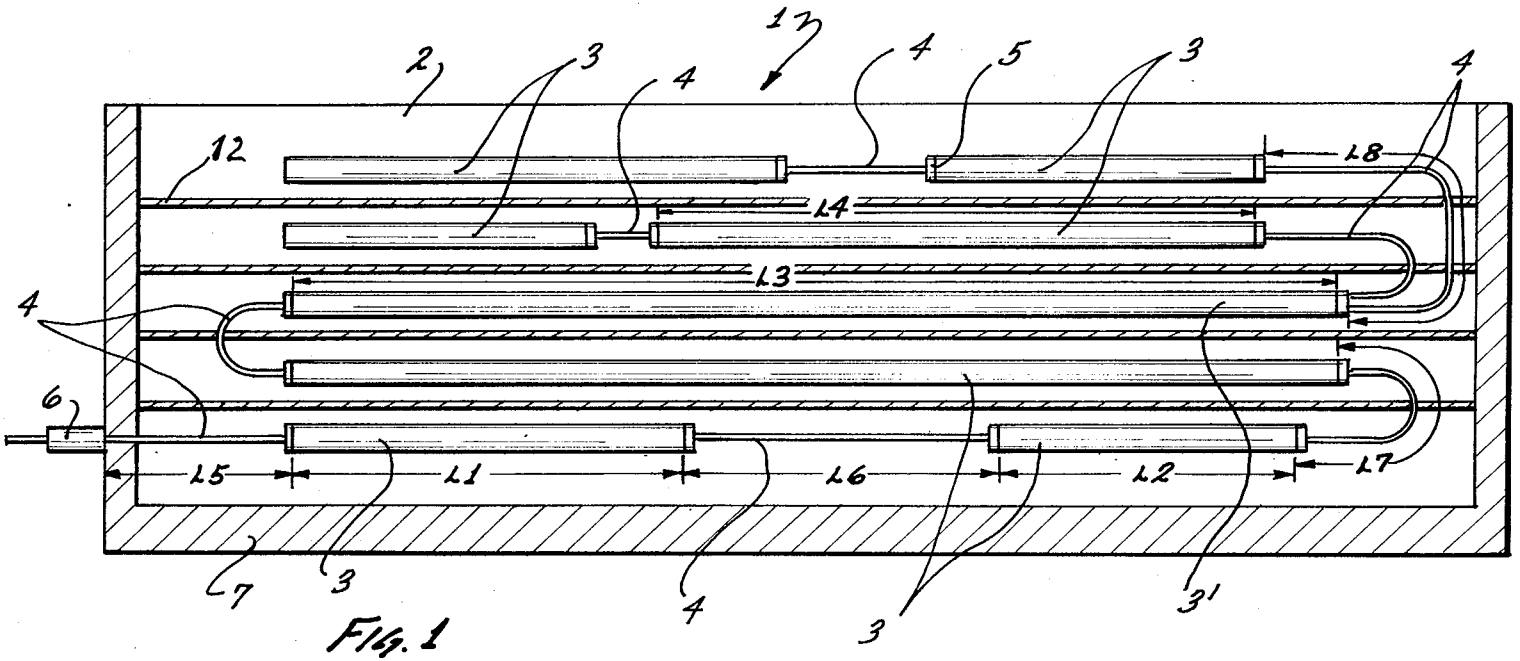
FIG. 1 is a schematic illustration of a gas generator in accordance with the preferred embodiment of the present invention for practising the best mode thereof, the gas generator being situated in an expansion chamber.

L1, L2, L3, and L4 denote different length values for the hoses 3, and L5, L6, L7 and L8 are different length values for ignition hoses 4. All of these lengths values could be similar but for purposes of control in the temporal development of pressure they may be differently long. This then means that the explosive charge hoses 3 contain charges of different values if in fact their lengths differ. The ignition hoses 4 serve basically as delaying the connecting devices between respective two hoses 3, and the respective lengths vary in order to obtain a program of delays in the pressure generation.

The initial ignition is carried out by means of an ignitor 6 being arranged on one end of the gas generator, on the outside of chamber 2, and being connected through an ignition hose 4 to the first one of the hoses 3 in the series. As is furthermore shown in FIG. 1 the end of one of the hoses namely hose 3' is connected to two ignition hoses 4 and thereby splits the strand into two branches. More than two branches can be provided for. Of course such splitting into branches can be included in a single series of hoses 3 and 4 or in an alternating fashion. In other words, split branches can be recombined down stream.

The gas generator is bounded by a wall 7. The various hoses 3 and 4 are arranged inside the generator 1 and particularly the different portions of expansion chamber 2 as provided in a lateral arrangement are shielded from each other through partitions 12 in order to reduce mutually effective pressure waves. As shown specifically in a modification of FIG. 1*a*, this shielding can be provided separately through a pressure proof jacket 14 arranged around the respective explosive charge hoses 3.

Figure 2:
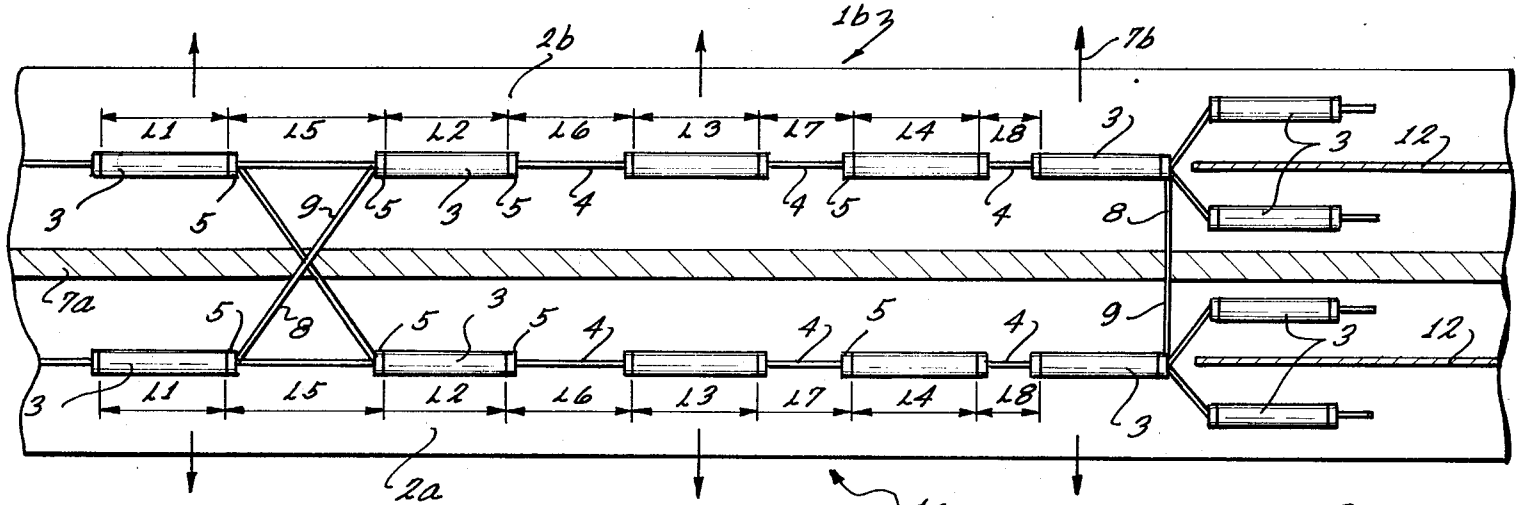
FIG. 2 is a schematic illustration of a gas generating device with two parallely operating generator systems.

FIG. 2 illustrates a modification wherein two juxtaposed expansion chambers 2*a* and 2*b* each contain a gas generator 1*a* and 1*b* respectively. Basically as described with reference to FIG. 1 each of these gas generators is comprised of a series and serially arranged set of explosive charge hoses 3 having a similar or dissimilar length and being interconnected through ignition charge hoses 4 under utilization of appropriate connectors 5. The ignition charge hoses 4 may again have similar or dissimilar length. The expansion chamber 2*a* is separated from the chamber 2*b* by means of a wall 7*a*.

Both generators 1*a* and 1*b* are simultaneously ignited and the resulting pressure gas is effective on both sides of the partition 7*a* (see arrows 7*b*). Both generators are, moreover, split at one end into two parallel branches. In order to make sure that the ignition of the individual hoses 3 is carried out in the desired manner cross connections 8 and 9 being ignition charge hoses interconnect the two generators 1*a* and 1*b*. Such an ignition connection is also provided at the branch point for each of the generators as can be seen in the right hand portion of FIG. 2. The ignition charge hoses 8 and 9 are appropriately arranged generally with respect to the gas generator strings in order to provide a redundant ignition of the respective adjacent generators.

Figure 1A:
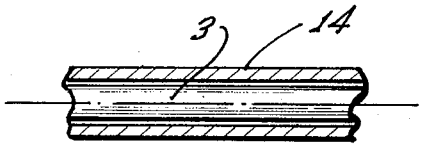
FIG. 1*a* illustrates a detail in FIG. 1.
Figure 3:
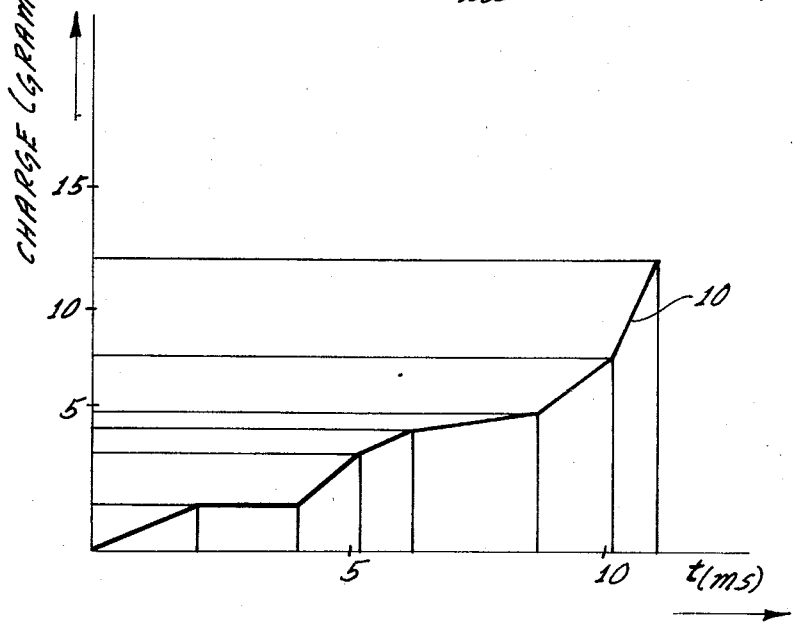
FIG. 3 is a diagram for illustrating the ignition sequence and stepwise development of propellant gas in an expansion chamber.

FIG. 3 illustrates a diagram 10 depicting the ignition of a gas generator or a generator system similar to those shown in FIGS. 1 and 2 whereby particularly consumed charge is plotted in dependence upon time in order to establish a constant or well defined gas generator inside the expansion chamber 2. Diagram 10 shows particularly the stepwise build up gas pressure through stepwise consumption of the requisite charges so that the desired ultimate gas pressure in the expansion chamber results from the requisite charges and combustion sequence. The gas pressure particularly is generated and results from the ignition sequence in the ignition hoses 4 being carried out in milliseconds, and the particular burnoff and combustion of the charges measured in grams and contained in the particular explosive charge hoses 3. The volume of the expansion chamber increases accordingly. This means that by virtue of the inventive arrangement involving particularly selective length of ignition hoses 4 in between individual charge hoses 3 the gas pressure buildup in the expansion chamber is variably controlled in terms of a preselected pressure buildup and charge consumption sequence.

The invention is not limited to the embodiments described above but all changes and modifications thereof not constituting departures from the spirit and scope of the invention are intended to be included.

I claim:

1. Gas generator situated in an expansion chamber and provided for developing pressurized propellant gas for ejecting projectiles from a container, the gas generator comprising a plurality of individual propellant gas producing explosive charge hoses serially interconnected by ignition charge hoses of selected length thereby establishing a string of alternating propellant explosive charge hoses and ignition charge hoses the propellant gas is solely produced serially by the gas producing hoses;

means for providing an initiation charge at one end of the resulting string; and means for providing pressure shielding of at least some of said propellant explosive charge hoses relative to others.

2. Gas generator as in claim 1 wherein said means for shielding includes partitions inside expansion chamber.

3. Gas generator as in claim 1 wherein said means for shielding includes a pressure proof jacket around the respective explosive propellant change hoses.

4. Gas generator as in claim 1 and including at least one parallel branch with at least one propellant charge hose and at least one ignition charge hose, there being shielding means provided in between said branches.

5. Device for the generation of gas pressure by means of explosive charges and including at least one expansion chamber comprising a plurality of propellant explosive charge hoses alternating with and being serially interconnected by a plurality of ignition charge hoses; and means for shielding at least some of said hoses from said hoses from others as far as pressure is concerned.

6. Device as in claim 5 there being at least two parallel branches of serially interconnected propellant explosive charge hoses, there being partition means separating the two serial generators as resulting therefrom.

7. Device for the generation of gas pressure by means of explosive charges and including at least one expansion chamber comprising a plurality of propellant explosive charge hoses alternating with and being serially interconnected by a plurality of ignition charge hoses there being at least two parallel branches of serially interconnected propellant explosive charge hoses;

partition means separating the two branches to thereby separate serial generators as resulting therefrom from each other;

means for shielding at least some of said hoses from said hoses from others as far as pressure is concerned; and cross connections between the two generator branches to obtain ignition redundancy.

* * * * *